United States Patent [19]

Roeger et al.

[11] 4,422,582

[45] Dec. 27, 1983

[54] FOOD PROCESSING MACHINE

[75] Inventors: Carl R. Roeger, Troy; William D. Miller, Bradford; Charles R. Goodin, Troy, all of Ohio

[73] Assignee: Hobart Corporation, Troy, Ohio

[21] Appl. No.: 313,532

[22] Filed: Oct. 22, 1981

[51] Int. Cl.[3] ..... B02C 18/36

[52] U.S. Cl. ..... 241/82.5

[58] Field of Search ..... 241/82.1–82.7

[56] References Cited

U.S. PATENT DOCUMENTS

| | | | |
|---|---|---|---|
| 271,398 | 1/1883 | Baker . | |
| 2,914,103 | 11/1959 | Ferris | 241/82.5 |
| 3,847,360 | 11/1974 | Seydelmann | 241/82.5 |
| 3,934,827 | 1/1976 | Seydelmann | 241/82.3 X |
| 4,003,521 | 1/1977 | Hess | 241/82.4 |
| 4,153,208 | 5/1979 | Vomhof et al. | 241/82.4 |
| 4,204,647 | 5/1980 | Jensen | 241/82.6 |

FOREIGN PATENT DOCUMENTS

| | | | |
|---|---|---|---|
| 1000281 | 11/1952 | France | 241/82.5 |
| 257,407 | 9/1926 | United Kingdom | 241/82.5 |

*Primary Examiner*—Mark Rosenbaum

*Attorney, Agent, or Firm*—Biebel, French & Nauman

[57] ABSTRACT

A meat grinder includes a bone chip remover in which the bone chips are removed at a radially outer region of the grinding plate through a single tangential opening substantially in the plane of rotation of the knife in response to intermittent operation of a valve. Knife blades which have substantial axial depth perpendicular to the plate are curved rearwardly to the direction of rotation, to apply an outward force component or pumping to chips which do not pass through the grinding plate, have terminal ends which sweep about a region radially outwardly of the perforated region of the plate, at a non-grinding or non-perforated region, behind which the chips are trapped and rotated about with the rotation of the knife blades for intermittent purging. The knife is formed with relieved areas at the radially inner ends of the blades to provide a region of communication, adjacent the grinding plate, between successive blades to prevent the formation of a central stagnation region and provide that bone chips missed by one blade may be acted upon by another to move chips outwardly.

2 Claims, 13 Drawing Figures

C-1
C-2
40
41
100
102
103
104
105
106
108
110
111
112
120
7
8
9

FOOD PROCESSING MACHINE

BACKGROUND OF THE INVENTION

This invention relates generally to food processing machines, such as a mixer-grinder, and more particularly to a meat grinder which incorporates a bone chip remover.

Generally, meat grinders employed in the processing of beef, pork, veal or lamb are used to form a ground meat product from utility grade meat. Utility grade beef, for example, generally includes older animals, such as older cows or steers, or parts of the younger steers that cannot be used for the better cuts of beef. Generally, the choice cuts of animals raised for beef are not processed in the mixer-grinders to which the present invention applies.

The meat cutters in large meat processing or meat packing plants are commonly paid in accordance with their production in removing the meat from the bones of slaughtered animals. As a result of the preparation of the meat, a certain amount of foreign material, most commonly gristle and bone particles or chips, finds its way into the meat product applied to a grinder. Where workers may be working at a piece rate, they may not be quite as careful in cutting the meat from the carcass and from the bones, and if they nick the bone with a knife, that piece of bone may ultimately finds its way into the grinder. For example, circular hand-held knives are used to remove meat from ribs, and if the cutter is not particularly careful, some bone may be removed along with the meat from the ribs and may find its way into a grinder. It has been estimated that, in larger meat processing houses grinding utility grade beef, approximately 1/10th of one percent (0.1%) of the meat product applied to grinders may consist of bone or bone chips.

Large mixer-grinder machines capable of handling several hundred pounds a minute or more, are generally operated on a substantially continuous basis. Quite often, the meat is subject to a double grind with the first grind being applied to a plate having ½ (12.1 mm) or ⅜ inch (9.53 mm) openings therethrough to form a relatively coarse grind. Then this meat product is either immediately ground a second time in a second grinder to a final cut with holes about ⅛ of an inch (3 mm) diameter, or the meat product is applied to a mixer-grinder where it is mixed and blended with seasoning, fat, extenders or the like, and then ground at a final grinding plate having the smaller diameter holes. Thus, the burden falls upon the grinder having the finer or final plate to prevent the unwanted bone particles from getting into the final product.

Not only is it undesirable to permit the bone particles to go through a grinder and ultimately into the final ground meat product, the presence of such particles, or excessive gristle, or other product which does not readily pass through the grinder plate severely degrades the productivity and capacity of the grinder. After a relatively short period of operation the capacity is reduced to the point where cleaning becomes necessary. Also, permitting the same to remain in the region of the grinder plate for any substantial period of time increases the likelihood that some of the bone chips will be reduced in size and passed through the plate, thus lowering the grade or quality of the ground meat. Thus, it is a customary practice in high capacity grinders, to stop the grinding operation after about twenty to thirty minutes of operation and clean out the collected bone chips, gristle and the like from the region behind the plate and about the knife. For example, a second grind at a grinder may initially produce approximately 280 lbs/min of ground meat product, but this will drop in about one-half hour's time to 230 or 240 lbs/min, depending upon the sharpness and quality of the cutting knife, the grinding plate, and the amount of fat, bone or gristle in the product. It becomes necessary to remove the grinding plate and clean out the bone chips and other particles. Running the grinder for a longer period of time increases the likelihood of cutting and grinding up the bones and passing them through the plate into the final product. Skilled laborers can thus clean out a grinding head in about five minutes down time, representing a loss of about ten minutes per hour or about a 15 percent loss of productivity.

There have been a number of attempts to produce a bone chip remover for a meat grinder, or to incorporate bone chip removing apparatus into existing grinder constructions. A primary problem in designing such systems is caused by the difficulty of separating the bone chips and other undesirable components such as gristle, from the meat itself without suffering a substantial loss of valuable meat product. Thus, it has proved to be difficult to separate the entrained chips, which account for only a very small percentage of the total meat product, in an effective manner.

Collection of bone chips, cartilage, gristle, sinews and fat in meat grinders tends to occur in large measure in the central region around the hub of the knife, immediately behind the plate. Whether this is the result of the much larger area at the outer periphery of the plate being open for the flow of meat therethrough or the likely greater force exerted by the outer flights of the grinder worm is not known. However, this congregation at the center of the plate has caused a number of parties seeking solutions to the problem of bone chip removal to capture them centrally and cause them to exit centrally through a tube or pipe to a disposal location outside of the grinder. Exemplary of such efforts are Seydelmann, U.S. Pat. No. 3,847,360 issued Nov. 12, 1974 and Seydelmann, U.S. Pat. No. 3,934,827 issued Jan. 27, 1976. Several commercial versions of central discharge of bone chips presently exist in the U. S. marketplace. Such units rely primarily on high meat pressure within the grindr, rather than physical action of mechanical parts, to force collected bone chips along its disposal path.

Another effort at removing bone chips in meat from behind the final grinding plate and causing their disposal is shown in U.S. Pat. No. 4,153,208 of Vomhof et al, issued May 8, 1979. In that structure, a unique knife arrangement is provided to take advantage of the central pressure packing of bone chips, channel the bone chips (and presumably red meat also) through grooves provided internally of the knife blades themselves, use the internal pressure of meat to drive the chips toward an outer peripheral region, and then use combined frictional force and pressure to drive the bone chips from the cylinder through a tangential slot after they have once been captured in a peripheral region. Like the aforementioned Seydelmann patents, Vomhof also accepts the apparent natural tendency of waste to congregate around the knife hub. Unfortunately, expensive meat can also easily follow the same path as the waste product, in both types of units where centralized collection is relied upon.

In yet another form of bone chip removal illustrated in Jensen, U.S. Pat. No. 4,204,647 of May 27, 1980, an attempt is made to counter the inward packing force of bone chips and gristle with knife blades which are intended to physically drive such particles radially outward toward the periphery of the cylinder. The cylinder periphery is provided with a series of slots in the knife plane, into which bone chips and the like are packed. As shown in this patent, a hinged shackle is clamped about the cylinder exterior to cover the slots. The machine must be stopped when the bone chips are to be removed, the shackle removed, and the machine jogged to cause meat pressure to extrude the bone chips or whatever is contained in the slots therefrom. The outer surface of the cylinder is then scraped clean and the shackle reinstalled. In a commercial version of this latter device, a slotted ring is provided in place of the shackle. The ring may be actuated by an air cylinder from one position in which the slots in the ring are out of alignment with the cylinder slots to close the slots, to a second position in which they are aligned. When so operated while the machine is running, time lost to shutdown is avoided. This design, in effect, provides multiple valve ports enabling the machine periodically to extrude bone chips collected in the slots. A potential disadvantage of the multiple slots of the '647 patent is that if any slots are packed tightly with bone chips, there may be loss of easily flowable red meat through some slots while the remaining slots remain tightly packed. Ideally, all of the slots should be equally packed, should have equal pressure applied thereto during purging, and all extrude their waste material simultaneously. The likelihood of this happening can be expected to be slim, and any tightly packed slots may never be freed of unwanted materials until the machine is shut down and manually cleaned. Obviously, if a single one of the slots opens up and extrudes whatever bones have collected therein before any other slots can open, the soft, easily flowable meat immediately therebehind will continue flowing out until the valve is closed.

At this early stage of development of this art, little factual information exists as to the actual amount of valuable meat which is extruded with the unwanted bone, cartilage and gristle. Because of its high cost, the loss of red meat must be kept to an absolute minimum. It is doubted that any of the prior art bone chip removal systems has the capability of the system about to be described, in terms of efficient waste material removal with minimum loss of meat with the waste.

SUMMARY OF THE INVENTION

The above described shortcomings and disadvantages of the prior art are to a great extent overcome by the meat grinder of the present invention. The meat grinder as disclosed and claimed herein is generally of the type which includes a barrel or cylinder which receives coarse-ground mixed meat from a mixer or container, including a delivery screw for conveying the premixed meat product through the cylinder to a grinding plate, and a cutting knife mounted on the end of the screw engages the product and cuts the same as it is forced through the extrusion openings formed in the plate. The bone chip remover apparatus includes a discharge outlet or opening which is formed generally in the plane or region of rotation of the knife in the wall of the cylinder, and incorporates a valve in a conduit leading therefrom for momentarily opening the conduit to outside pressure or to a region of lower pressure, whereby any material within the conduit and inwardly thereof is discharged by the differential pressure.

An important provision of the invention resides in the construction of the knife and the manner in which it cooperates with the plate and the cylinder, to cause bone chips and the like to be collected primarily in discrete rotating peripheral regions inside the cylinder. The knife is formed with blades which have a sweep or a rearward slope or inclination at least with respect to the leading edges, providing what can be described as a centrifugal pumping action. This is identified as a trailing sweep, or arcuately rearward inclination, so that bone chips or other solid foreign matter or particles which engage the grinding plate but which are not capable of moving through the extrusion holes are contacted by the swept-back leading knife edges and are urged outwardly into the outer region defined by the unperforated annular outer portion of the grinding plate and the blade ends. The tips or ends of the blades which extend into this outer portion and in very near proximity to the inside of the cylinder, form a moving series of arcuate segments at the outer edges of which the bone chips are trapped and are temporarily stored and prevented from being further reduced since this annular region is radially outward of the extrusion opening pattern formed in the grinding plate.

In the preferred construction of the knife, there is formed a common inner relieved region by means of which the space immediately forward of one blade may communicate with the space immediately forward of the next following blade. A common space is defined between the inner radial ends of the blades and the center or inner unperforated portion of the grinding plate. This central interconnecting region permits the migration of bone chips which may move inwardly or which may not be positively carried outwardly, to pass behind one blade and be engaged by the leading swept edge of a successive blade, with the potential that it may be thereby urged outwardly by reason of the outward force component caused by the blade inclination. When a segment between two blades is purged of bone chips, the pressure drop in that segment enables the higher pressure in the remaining segments to displace some bone chips from the relieved region into the lower pressure area. This in turn permits the leading edge of the blade in the purged section to pick up such chips and pump them outwardly. By providing a single discharge port, only one segment is purged at a time, although the randomness of purging will momentarily cause one segment to be opening just as the previous one is being closed. Bone chips can thus pack into the central relieved region initially, but are partially purged therefrom intermittently.

A timed valve is incorporated into a passageway leading from a tangential opening in the cylinder, which may be opened from time to time for a relatively short time interval so that the material trapped in the outer segments between the blades may be purged. Preferably the timed valve means consists of a pneumatically operated plunger valve which opens for only a relatively short period of time, substantially less than a single revolution of the knife, thus resulting in the venting or purging of only a portion of the moving perimeter. Valve operation is random with respect to knife rotation and is accomplished on a regular, but adjustable intermittent basis. Thus, eventually all of the arcuate segments between the blade tips and the outer cylinder wall will be purged of accumulated material. In the event the passageway should become plugged tightly, a manual override of the timer is possible to maintain the valve open for a sufficient length of time to clear the obstruction.

A further important feature resides in the arrangement by which the grinding plate is supported in the cylinder in such a manner as to provide for a full circumferential sweep of the tips of the blades about the outer unperforated region of the grinding plate. To this end, the open end of the cylinder is preferably formed of uniform inside diameter to receive the knife, the grinding plate, and also to receive, forward of the grinding plate, an annular collar or sleeve. The cylinder is formed with an axially aligned pin-locating or receiving groove in the inside surface thereof, which groove is positioned radially opposite a corresponding outwardly opening pin-locating or receiving groove in the grinding plate. The groove in the cylinder extends axially forwardly from the grinding plate throughout the forward uniform inside diameter of the cylinder to its open end, and the sleeve supports an axially extending locating pin on its perimeter or on its outer surface. The outside diameter of the sleeve is proportioned to form a close fit with the inside diameter of the cylinder. Further, the inside face of the sleeve abuts against the adjacent outside surface of the grinding plate, while the outer end of the sleeve is engaged by the adjusting ring so that, in effect, the sleeve is held in compression against the plate and in turn holds the plate firmly in cutting engagement with the knife. The axial extent or length of the pin is such that it extends into the plate groove to an axial depth less than the thickness of the plate, thereby locking both the plate and the sleeve against rotation, while leaving the inside diameter of the cylinder in the plane of the knife to be approched very closely by the tips of the knife blades.

It is accordingly an important object of this invention to provide a meat grinder having a bone chip remover, as outlined above wherein the bone chips, gristle, or other particles which do not readily pass through the grinding plate, are moved in a generally radial direction, with the rotation of the knife blades, to a region beyond the perforated or effective region of the grinding plate and are trapped therein between the extended tips of a rotating cutting knife from which region this material may be, from time to time, purged.

A further important object of the invention is the provision of an improved cutting knife having rearwardly swept blades, preferably blades which sweep along a rearwardly inclined arc, to effect an outward force component to bone chips which impinge against the leading edges of the blades.

Another object of the invention is the provision of an improved device, as outlined above, in which the inner or root ends of the blades, around a hub portion adjacent the grinding plate, are open or otherwise relieved to form a common inner passageway which interconnects the regions between adjacent blades and provides, in conjunction with the blade tips which are in close proximity to the inside of the cylinder, for periodic purging of bone chips from the relieved portion in response to cylinder purging.

Another object of the invention is to provide a bone chip remover in combination with a meat grinder in which a tangential opening is formed in the cylinder, in the plane or region of the knife, and in which the knife is provided with blades which coact closely with the inside wall of the cylinder and at a region radially outwardly of the perforations of the grinding plate to form rotating, non-extruding regions in which bone chips or other deleterious material may be trapped for purging through the tangential opening.

A still further object of the invention is the provision of a bone chip remover, of the general kind outlined above, in which knife blades are swept rearwardly of the direction of rotation to provide a force component on particles incapable of readily passing through a grinding plate for moving such particles to a radially outward zone.

A still further object of the invention is the provision of a meat grinder having bone chip removing capabilities in which an opening formed in the cylinder wall in the region of the plane of rotation of the cutting knife is intermittently vented to discharge bone chip material from a radially outer region of the plate by means of an intermittently operated closure valve, to remove rotating pockets of bone chip material which are trapped in a region radially outwardly of the perforated region of the plate by the knife blades.

These and other objects and advantages of the invention will be apparent from the following description, the accompanying drawings and the appended claims.

DESCRIPTION OF THE PREFERRED EMBODIMENT

General Description

Figure 2:
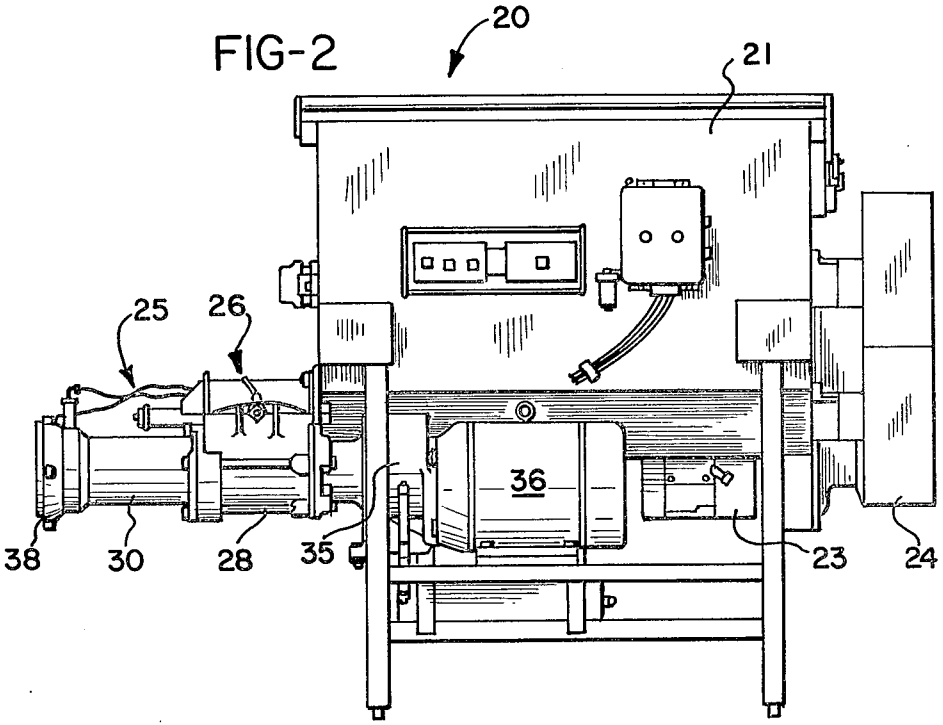
FIG. 2 is a side elevation of the mixer-grinder of FIG. 1.
Figure 1:
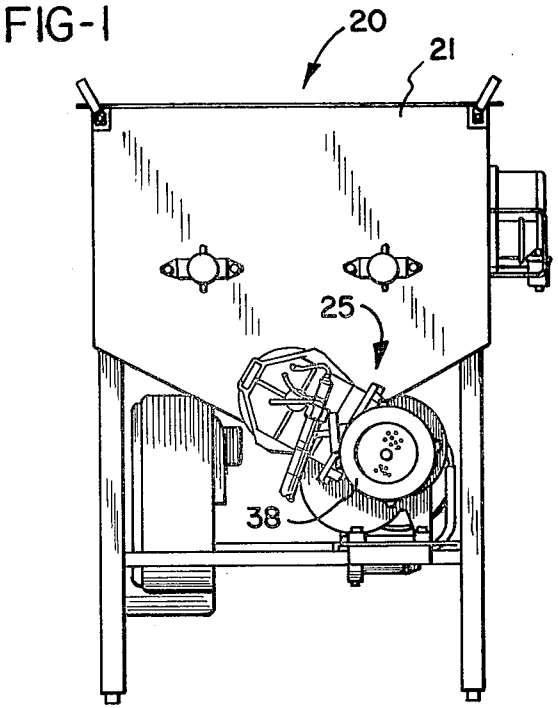
FIG. 1 is a front elevational view of a mixer-grinder having a bone chip remover in accordance with this invention.

A mixer-grinder to which the bone chip remover apparatus of the present invention has been applied is illustrated generally at 20 in FIGS. 1 and 2 as including a hopper 21 into which the meat product to be ground is applied. It is understood that generally a coarsely ground or flaked meat product is applied to the hopper, which may also be in a frozen or partially frozen condition. The hopper 21 is provided with a pair of coacting, rotatably mounted blending and mixing arms, not shown, which engage the meat product in the hopper and mix and blend the ingredients prior to final grinding.

The mixing within the hopper 21 is accomplished by a pair of counter-rotating, interrupted helical mixing arms. The mixing arms may rotate at a relative low rate of rotation, such as between 10 and 15 revolutions per minute, as driven by a motor and transmission 23 through a secondary speed reduction mechanism 24. The arms making up the blending and mixing apparatus may be essentially as shown in Hartley et al, U.S. Pat. No. 3,570,569 issued Mar. 16, 1971, or Hartley, U.S. Pat. No. 3,984,056 issued Oct. 5, 1976, and assigned to the same assignee as this invention.

The mixing apparatus forming a part of the mixer-grinder 20 may thus be used to blend the meats with moisture, seasoning, fats or other products which are desired in the final grind. In large mixer-grinders, the hopper may hold 2,000 pounds or more of meat product which may have previously been ground or flaked, for a final mixing or grinding.

The mixer-grinder 20 further includes a grinding section which is illustrated generally at 25 in FIGS. 1 and 2. For this purpose a stainless steel feed screw (not shown) is located at the bottom of the hopper, and is driven by the mixer motor 23. The forward end of the feed screw extends into a feed chamber 26 mounted on the forward end of the hopper 21 as shown in FIGS. 1 and 2. The feed chamber 26 is open at one side to deliver the meat product from the hopper to the inlet or feed bowl portion 28 of a grinding cylinder 30, as is perhaps best shown in FIG. 10. The grinding cylinder 30 and its feed bowl portion 28 rotatably receive a grinding screw or worm which is illustrated generally at 32 in FIG. 10. The worm 32 includes a feed section 33 at the inner end thereof received essentially within the feed bowl portion 28 of the cylinder 30, which has flighting of relatively long pitch, leading to a pressure or delivery section 34 received within the cylinder 30 proper, which has flighting formed with a shorter pitch.

The worm 32 is driven, through reduction gearing 35 by a grinder motor 36, shown in FIG. 2, at a speed which is substantially higher than the speed of the mixing arms within the hopper 21, in the order of from 200 to 300 revolutions per minute, for example. The forward end of the grinding cylinder 30 supports a conventional end adjusting nut or ring 38.

Referring again to FIG. 10, the end of the worm 32 has threaded therein a protruding stud 39 which, in turn, supports and drives a cutting knife 40 against a grinder plate 42. Thus, hub 41 of the knife 40 is conventionally mounted on the forward end of the screw 32 at the grinding plate 42 for cutting the meat product at the plate and for delivery thereof through the open end of the cylinder 30. The forward or discharge end of the cylinder 30 is formed with an enlarged counterbored end or section 45 of uniform inside diameter beginning substantially at the forward end of the screw 32. This enlarged section includes and defines the grinding station, and the grinding plate 42 has an outside diameter which forms a close clearance fit with the inside wall or surface 46 of the enlarged section 45. The bottom or inner end 46' of the counterbored section 45 serves to help trapped bone chips from moving rearwardly as will be noted hereinafter.

Conventionally, the grinding plate 42 may be formed with a forwardly extending knob portion 47 and is further formed with a central aperture or opening which receives the forward end of the knife-supporting stud 39 and thus pilots and supports the forward end of the worm 32 within the cylinder 30.

Figure 5:
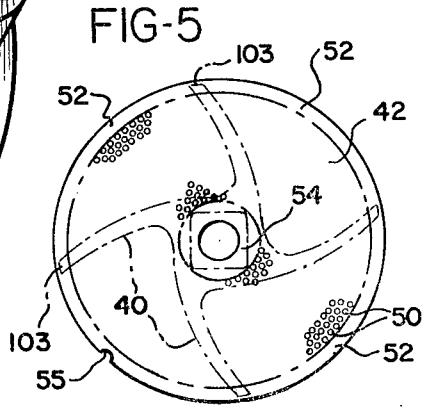
FIG. 5 is a rear elevational view of a grinding plate, showing in phantom the operating position of the knife relatively thereto.
Figure 11:
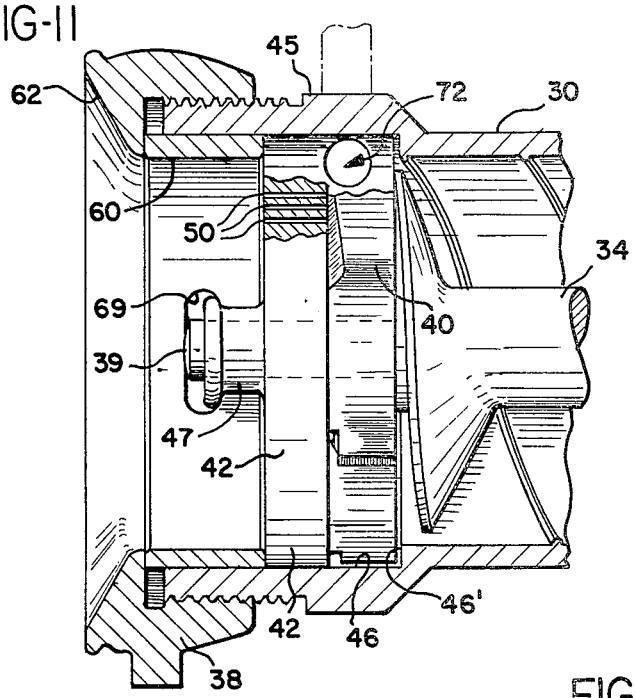
FIG. 11 is a fragmentary section through the cylinder at the grinding end thereof looking generally as viewed by the line 11—11 of FIG. 3.

The grinding plate 42 used with the bone chip remover apparatus of this invention may best be seen in FIGS. 5 and 11, and is essentially of conventional construction. Thus, as viewed in FIG. 5, the grinding plate 42 is formed with an annular pattern of holes or extrusion openings 50 therethrough, which may be in the order of one-eighth of an inch (3 mm) in diameter for the final grind, for example. The extrusion openings 50 are formed generally in an annular pattern, the outer diameter of which terminates radially inwardly of the plate periphery so that the plate 42 is formed with a solid non-extruding annular perimeter 52. Similarly, the inside diameter of the pattern of openings 50 terminates at the knob 47 to form a non-extruding center section 54.

The grinding plate 42 is further provided with an outwardly opening axial key or pin-receiving slot or groove 55 formed in the outer surface thereof, shown in FIG. 5.

GRINDING PLATE SUPPORT

Figure 10:
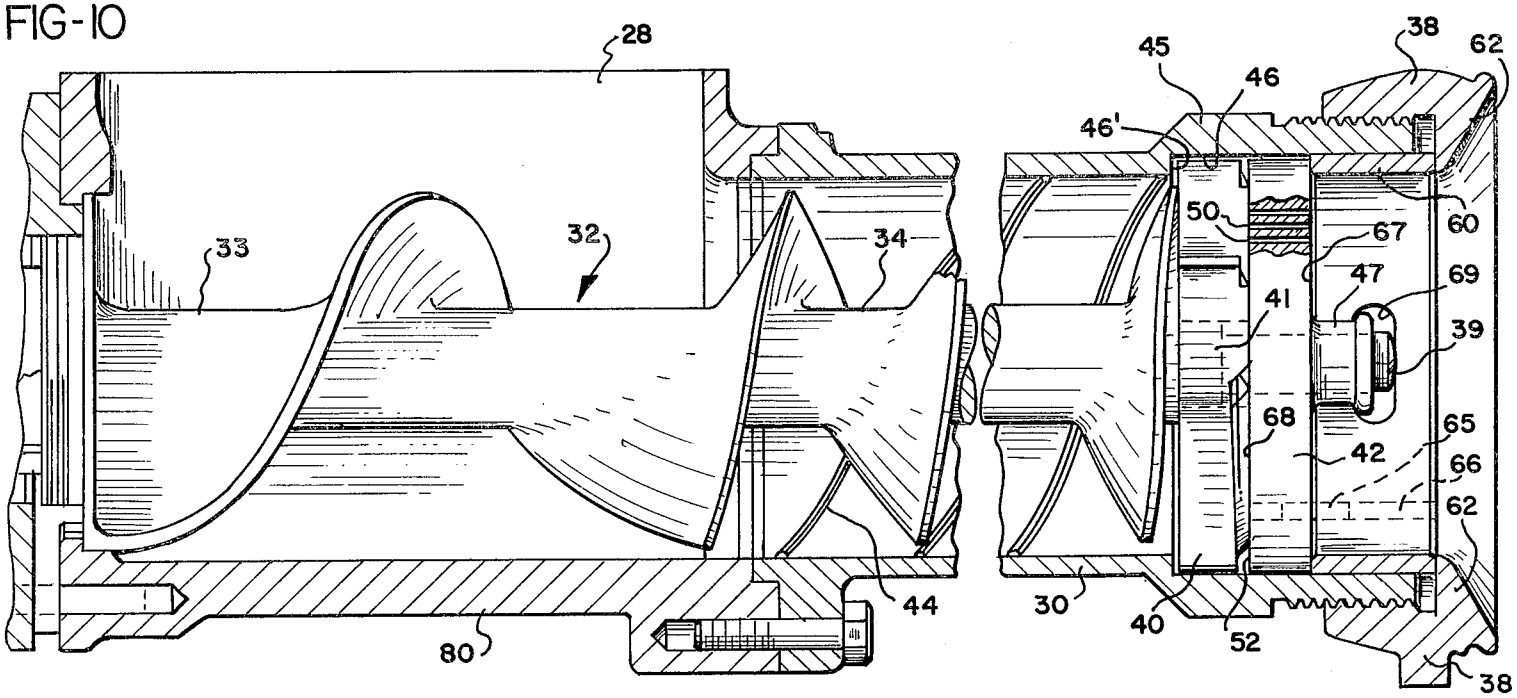
FIG. 10 is a longitudinal section, partially broken away, through the cylinder taken generally along the line 10—10 of FIG. 3.
Figure 12:
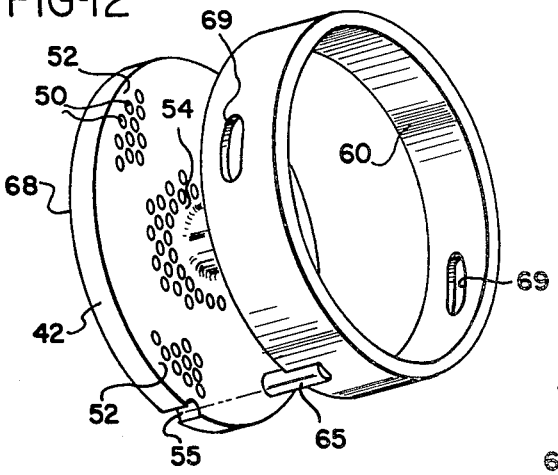
FIG. 12 is a front perspective exploded view of the plate locating sleeve and the grinding plate.
Figure 13:
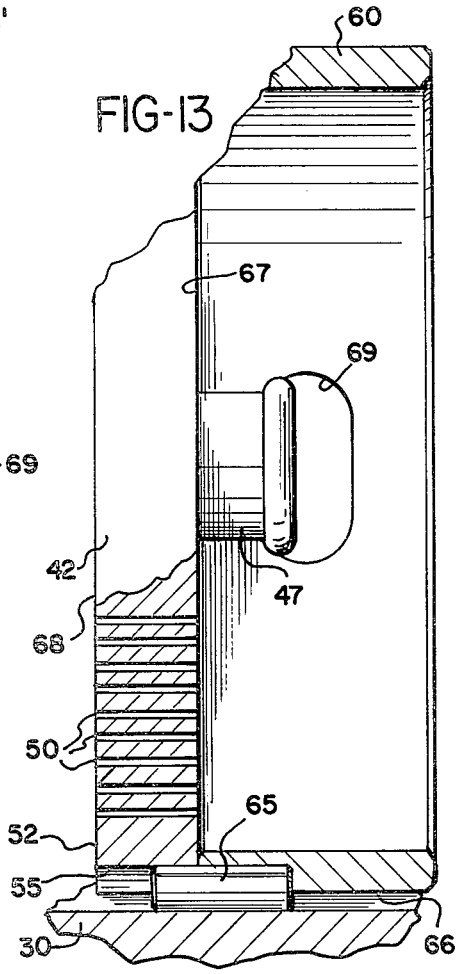
FIG. 13 is an enlarged fragmentary section showing the sleeve with the locating pin thereon assembled in the cylinder and engaging the grinding plate.

Means forward of the grinding plate 42 for supporting the grinding plate within the section 45 of the cylinder 30 providing for limited axial movement of the plate and for preventing rotation of the plate within the cylinder includes an annular sleeve 60, FIG. 12. The sleeve 60 is formed with an outside diameter which, like the plate 42, forms a relatively close fit with the inside diameter or wall 46 of the cylinder. The sleeve 60 is proportioned to extend slightly forward of the terminal or forward end of the cylinder 30 to be engaged by an inwardly extending conventional annular flange 62 of the adjusting ring 38, as shown in FIG. 10. The sleeve 60 includes an axially inwardly extending locating key or pin 65 preferably integral therewith which is partially received in an axially elongated cylindrical groove 66 formed in the section wall 46, and axially alignable with the slot or groove 55 formed in the plate 42. The location pin 65 is supported on the sleeve so that approximately one-half the diameter of the pin 65 is received in the sleeve 50 and extends axially rearwardly from the sleeve 60, so that it may be partially received within the notch or groove 55 of the plate 42 and partially in the cylinder groove 66. When so received, the rear wall 67 of the sleeve 60 is in flat abutment with the adjacent annular peripheral or forward face of the plate 42, essentially outwardly of the pattern of holes 50 and at the non-extrusion perimeter portion 52.

The axial length of the pin 65 rearwardly of the sleeve 60 is substantially less than the total axial depth of the plate 42 so that, allowing for normal wear and resurfacing of the grinding plate 42, no portion of the pin 65 will extend to the inside cutting or grinding surface 68 of the plate. Accordingly, the grinding surface 68 of the plate 42, including the outer non-extruding perimeter portion 52, is free of any obstruction, thus providing for an unobstructed sweep of this periphery throughout a full 360° extent by the blades of the knife 40.

The sleeve 60 transmits force from the end adjusting ring 38 to the plate 42 and from the plate 42 to the knife 40 to assure a proper cutting contact with the blades of the knife 40 against the cutting surface 68 of the plate 42. The pin 65 locks the plate 42 against rotation relative to the cylinder. The sleeve 60 may conveniently be provided with side finger openings 69, as shown in FIGS. 10–13, to assist in its insertion and removal from the cylinder 30.

BONE CHIP REMOVER

Figure 3:
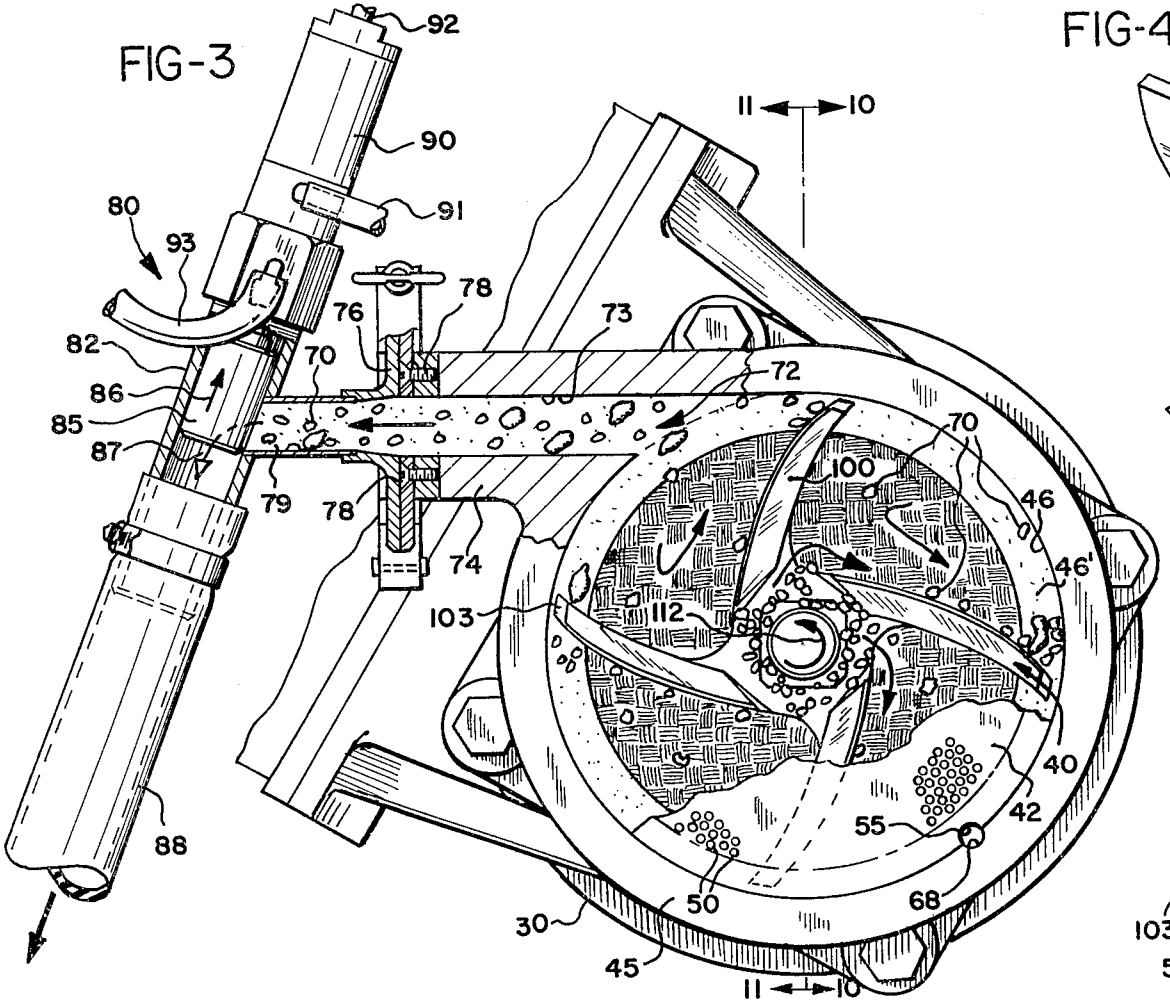
FIG. 3 is an enlarged frontal view of the cylinder with the adjusting ring removed and with the grinding plate and other portions of the apparatus being partially broken away or sectioned.

As previously noted, the bone chip remover of this invention is applied to the cylinder at the region of the knife 40, and a substantial portion of the apparatus is illustrated in FIG. 3.

FIG. 3 shows a fragment of the grinding plate, but primarily shows the cutting region or grinding chamber formed immediately behind the grinder plate with the knife in place, while the unit is under operation. The individual bone chips or particles which do not move through the grinding plate are illustrated generally at 70. The bone chips 70 and a certain inevitable amount of accompanying meat product are removed through a tangential outlet opening 72 formed in the cylinder wall 46, radially opposite the knife 40. The outlet opening 72 leads immediately to a generally tangential aligned conduit or passageway 73 formed in a wall extension 74 of the cylinder 30. The outlet opening 72 is thus positioned at the high pressure grinding region outwardly of the knife blades and, as shown in FIG. 11, immediately axially inwardly of the grinding plate 42. This region is bounded forwardly by the portion 52 of the plate 42 and rearwardly by the counterbore surface 46'. Together they aid trapping of bone chips to assist in packing them into the passageway 73. The passageway 73 leads directly into an aligned opening formed in an adapter 76 bolted onto the wall extension 74 by means of bolts 78. The adapter 76 is connected to the inlet 79 of valve means indicated generally at 80. The valve means 80 has the function of momentarily opening the passageway 73 into a region of relatively lower pressure, for purging of accumulated bone chips 70.

Valve means 80 is formed with a cylindrical conduit or body 82 which reciprocally houses a closure plunger 85. The plunger 85 is movable between a position in which the inlet 79 is closed off, as shown in FIG. 3, to a retracted position in the direction of the arrow 86 in which the inlet 79 is uncovered, permitting momentary flow as illustrated by the arrow 87.

Means for operating the plunger 85 in a reciprocating manner includes a double-acting air cylinder 90 having air inlets 91 and 92 by means of which a piston within the cylinder 90 is controlled, to control the movement of the valve plunger 85. In the event any food or meat particles are carried by the plunger to a region above the plunger, a purge line 93 is provided by means of which such meat particles may be bled off to a remote region, so as not to impede the proper operation of the plunger 85.

The plunger valve 85 is operated on an intermittent basis, such as in a cycle of operation, in which the plunger valve 85 is retracted to a flow-permitting position in the direction of the arrow 86 for a relatively short period of time, and thereafter immediately returns to its flow blocking position, as shown, during which time a slug of bone chip laden meat material is discharged in the direction of the arrow 87 into a discharge pipe and into a catch basin, a bucket or the like.

Figure 4:
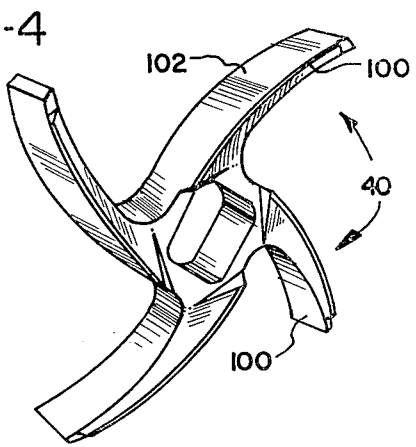
FIG. 4 is a front perspective view of the knife.

As noted above, the knife 40 and the grinder plate 42 cooperate in a unique manner to cause the bone chips and other particles which do not readily pass through the extrusion openings or perforations 50 in the grinder plate to be carried and moved outwardly of the grinder plate and trapped at a peripheral region of the plate within the enlarged grinding portion 45 of the cylinder 30. To this end, reference may be had to the perspective view of the knife FIG. 4 and the detailed views as set forth in FIGS. 6–9.

It will be seen that the knife 40 is provided with four symmetrical knife blades 100 integrally leading from the hub 41. Each of the blades 100 is formed with a substantial axial depth, corresponding substantially to the axial dimension of the opening 72 formed in the wall of the cylinder portion 45. Thus, each blade 100 is formed with a leading or forward face surface 102 which is essentially normal to the grinding face 68 of the grinding plate 42. The tips 103 of the blades extend radially beyond the perforated region of the plate, and sweep or overlie the non-extrusion outer or non-perforated section 52, as shown in FIGS. 3 and 5. The outer ends or terminal surfaces 104 of the tips 103 of the blades 100 form a close running fit with the adjacent cylinder wall 46 thereby defining between the blades arcuate segments of the outer section 52 of the grinding plate. The tips of the knife blades 100 are slightly relieved as indicated at 105 in FIGS. 6 and 9 for the purpose of equalizing the wear of the knife, by confining rubbing contact of the knife to the perforated region of the plate.

The knife blades 100 are arranged essentially in staggered relation around the square stud-receiving central knife opening 106 in the hub 41, and the knife blades 100 are only slightly tapered in thickness. The forward or face surface 102 of each of the knife blades 100 is generated by or forms an arc about center C-1 of FIG. 6, while the back or trailing surface 108 is formed as an arc about center C-2. The axial forward edge adjacent the plate consists of a ground cutting edge 111 flush with the cutting face 68 of the grinding plate 42 and a trailing surface 110 beveled inwardly as illustrated in FIG. 8.

Figures 6, 7, 8, 9:
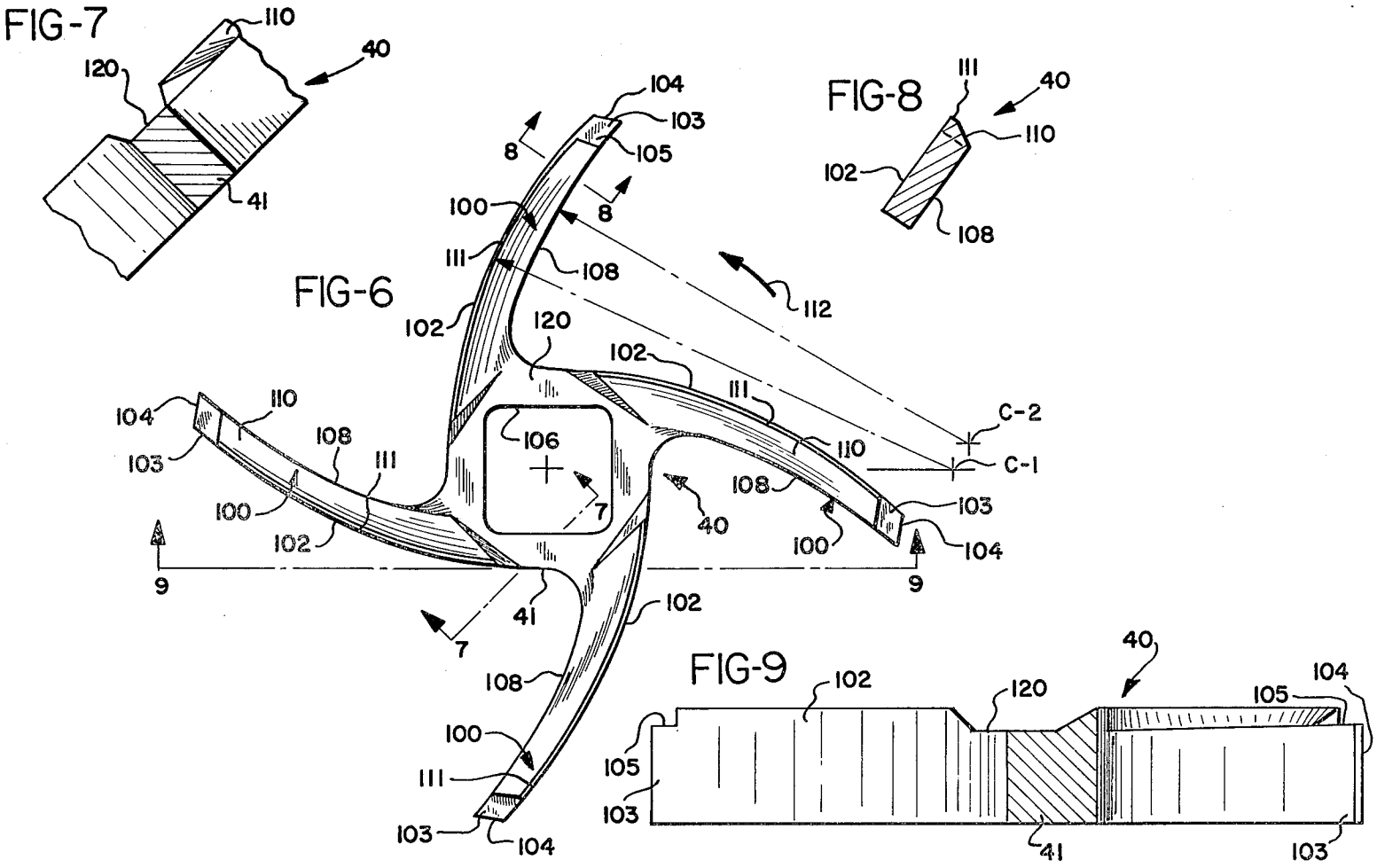
FIG. 6 is an enlarged front elevational view of the knife of this invention.
FIG. 7 is a fragmentary section through the hub of the knife taken generally along the line 7—7 of FIG. 6.
FIG. 8 is a transverse section through one of the knife blades taken generally along the line 8—8 of FIG. 6.
FIG. 9 is another transverse section through a radially inner portion of one of the blades taken generally along the line 9—9 of FIG. 6.

In order to assist in the movement of bone chip particles radially outwardly into the arcuate regions between the blades at the cylinder wall, the knife blades 100 are formed with a forward surface 102 which is inclined to the direction of rotation, as illustrated by the arrows 112 in FIGS. 3 and 6, to provide an outward force component or pumping action to those of the particles or chips 70 which do not readily pass through the grinding plate.

The forward surface 102 of each of the blades 100 of the knife 40 presents to the bone chips a surface which is inclined and recedes from the direction of rotation in such a manner that an outward force component is applied to the chips to assist in movement thereof to the outer regions of the grinding plate. The curved surface 102 is preferred since the partial wrap or a rearward inclination further maintains the angle between a tangent line and a radius at any point on the surface such as to provide a useful outward force component. Stated another way, the forward blade surfaces 102 may be considered as being formed with a curvature in the radial direction which recedes from the direction of rotation 112 so that bone chips and other fragments 70 encountering such forward surfaces of the blades are propelled or are urged toward the blade tips, where they are then trapped outwardly of the perforated region of the plate between the non-extrusion section 52 and the counterbore 46' and where these chips then are rotated about the inside perimeter of the cylinder portion 45 by the blades 100. The region between any two blades is therefore carried around by the knife from its throat area to the tips until the meat opposite the perforations is extruded through the plate and the material trapped behind section 52 is purged through opening 72.

The back surfaces 108 of the individual blades 100 are thus also curved and are substantially parallel to the axis of the cylinder or, in other words, normal to the grinding face. The inner ends of the blades, at a generally common region of the hub 41 adjacent the grinding face but essentially inwardly of the extrusion region 50, at the non-extrusion center region 54, are axially relieved as illustrated by the relieved portion 120 in FIGS. 6 and 9. The relieved portion 120 provides for communication, or provides a space, between the knife and the adjacent surface of the grinding plate. The chips, which may be forced dynamically by reason of the overall flow toward the center of the knife blade, if not carried radially outwardly, may migrate through the common opening defined by the relieved area 120 to be engaged by the leading edge 102 of a succeeding blade 100. Thus, the relieved portion 120 effectively prevents the formation of stagnant pockets at the inner or root ends of the blades which might otherwise tend to accumulate gristle or chips. As any one region between two blades is purged through the opening 72, the much greater pressure in the other three regions between blades will force bone chips collected in relieved area 120 to move toward the opening 72 and thus within the range of the curved face of a blade. This is made possible to some degree by the tips of the blades being able to essentially seal off the purged region, although the backside of the region is open to meat under high pressure except at counterbore 46'. This has been observed by noting that bone chips are frequently in one of the four knife throats more than the others right after a purging.

The chips will thus be concentrated generally in the manner illustrated in FIG. 3 and will be rotated by the blade tips about the grinding plate at the non-perforated outer region. Since the region immediately behind the grinding plate is at relatively high pressure, when the valve plunger 85 is momentarily opened, at least one of the arcuate segments or regions, and perhaps a portion of another will be purged of accumulated material through the tangential outlet 72. Since the timing of the valve 80 is not related to the same time base as the rate of rotation of the knives, eventually each of the rotating region will be purged while other regions tend to continue accumulating a concentration of bone chips. As the bone chips concentrate, good meat product is thereby displaced for proper cutting and movement through the grinding plate in the normal manner.

Operation

The operation of the apparatus of this invention is largely self-evident from the foregoing description. Preground or coarsely ground or flaked and perhaps partially frozen meat, fat, extenders, spices or other materials desired in the final grind are entered into the hopper 21 of the mixer-grinder 20 and mixed by the internal mixing arms. At the conclusion of the desired mixing, the mixer motor 23 is reversed in direction, thus delivering the mixed product in the conventional manner to the inlet section 28 of the grinding cylinder 30 where the product is picked up by the screw 32 and carried forwardly to the enlarged cylinder grinding region 45 where the same is acted upon by the rotating blades of the cutting knife, acting against the grinding plate 42.

In the manner previously noted, the bone chip particles 70 will be accumulated and temporarily stored in the outer periphery adjacent the tips of the blades. The purge valve means 80 will be operated by the air cylinder 90 on an intermittent timed basis of relatively short duration, so that the plunger 85 is momentarily opened, venting the passageway 73 to a region of relatively low pressure, such as atmospheric pressure, thereby suddenly causing an expelling of the accumulated bone chips from whatever arcuate segment is exposed to the tangential opening 72.

The duration of the opening of the valve means 80, and the frequency which the same is opened, is not particularly critical to the operation of the invention. For example, the plunger 85 may be opened for as short a time as a 0.050 second or less, or it may be opened for a substantially longer period of time, such as ½ second, depending upon the operating pressure within the cylinder, the grinding rate or speed of rotation of the worm 32, the nature of the food or meat product being ground, and the extent of contamination by bone chips. Likewise, the frequency of operation of the plunger may be controlled or varied by suitable timing means, not shown, applying control air pressure to the operating cylinder 90. Thus, for example, the plunger may be operated as frequent as once every two or three seconds, or the plunger may be operated only a few times a minute, as necessary to effect a purging and removal of the accumulated bone chips, without undue removal and waste of uncontaminated meat product. The mixer-grinder 20 may thus be operated on a more or less continuous basis, at least over a period of time which substantially exceeds that which it could otherwise be operated, where it is necessary manually to clean out accumulated bone chips, thus eliminating the periodic necessity of stopping and disassembling the grinder for this purpose. A manual override (not shown) is also provided for purging independently of the automatic control system in the event the passageway becomes plugged. A button may simply be used to actuate air cylinder 90. This can be done anytime it is noticed that material is not being discharged.

While the form of apparatus constitutes a preferred embodiment of this invention, it will be understood that the invention is not limited to this precise form of apparatus, and that changes may be made in either without departing from the scope of the invention.

What is claimed is:

1. In a meat grinder having bone chip removal and including a cylinder, a grinding plate at a discharge end of said cylinder, a screw rotatably mounted therein for conveying a meat product to said grinding plate, and a knife mounted on the end of said screw at the grinding plate for cutting the meat product, the improvement comprising the combination of:

means in said cylinder immediately axially inwardly of said grinding plate defining a bone chip discharge outlet, said grinding plate having a pattern of extrusion holes therethrough, which pattern terminates radially inwardly of the plate periphery to form an outer solid annular perimeter, a knife having an integral central hub and blades with tips thereof extending radially beyond said hole pattern and sweeping in close proximity to the inside surface of said cylinder, said blades being of substantially uniform depth in an axial direction throughout their lengths, each blade having a forward surface generally normal to a radial plane therethrough, said forward surface being formed with a curvature in the radial direction which recedes from the hub opposite to the direction of rotation of the knife so that bone chip fragments encountering said forward surfaces are provided with an outward force component tending to move said chips toward the tips of said blades, said blades effectively sealing off arcuate segments of space between adjacent blades and thereby providing a series of spaces for entrapment of said bone chips for purging through said discharge outlet, a conduit leading from said discharge outlet, and valve means in said conduit for opening said conduit to discharge into a region of low pressure whereby accumulated meat product rich with bone chips or the like is removed from said perimeter region.

2. The combinations of claim 1 wherein said central hub defines a relieved area common to said blades at the radially inner portions thereof providing a space between said knife and the adjacent surfaces of the grinding plate where bone chips may migrate between said entrapment spaces.

* * * * *